US008124307B2

(12) United States Patent
Sacripante

(10) Patent No.: US 8,124,307 B2
(45) Date of Patent: Feb. 28, 2012

(54) TONER HAVING POLYESTER RESIN

(75) Inventor: Guerino G. Sacripante, Oakville (CA)

(73) Assignee: Xerox Corporation, Norwalk, CT (US)

( * ) Notice: Subject to any disclaimer, the term of this patent is extended or adjusted under 35 U.S.C. 154(b) by 486 days.

(21) Appl. No.: 12/413,816

(22) Filed: Mar. 30, 2009

(65) Prior Publication Data

US 2010/0248122 A1 Sep. 30, 2010

(51) Int. Cl.
*G03G 9/087* (2006.01)

(52) U.S. Cl. ..... 430/109.4; 430/108.8; 528/286

(58) Field of Classification Search ..... 430/109.4, 430/108.8; 528/286
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,983,045 | A | 9/1976 | Jugle et al. |
| 4,265,660 | A | 5/1981 | Giflo |
| 4,935,326 | A | 6/1990 | Creatura et al. |
| 4,937,166 | A | 6/1990 | Creatura et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,593,807 | A | 1/1997 | Sacripante et al. |
| 5,650,255 | A | 7/1997 | Ng et al. |
| 5,650,256 | A | 7/1997 | Veregin et al. |
| 5,686,218 | A | 11/1997 | Liebermann et al. |
| 5,723,253 | A | 3/1998 | Higashino et al. |
| 5,744,520 | A | 4/1998 | Kmiecik-Lawrynowicz et al. |
| 5,744,572 | A * | 4/1998 | Schumann et al. ..... 528/286 |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,977,210 | A | 11/1999 | Patel et al. |
| 5,994,020 | A | 11/1999 | Patel et al. |
| 6,020,101 | A | 2/2000 | Sacripante et al. |
| 6,120,967 | A | 9/2000 | Hopper et al. |
| 6,130,021 | A | 10/2000 | Patel et al. |
| 6,628,102 | B2 | 9/2003 | Batson |
| 6,664,015 | B1 | 12/2003 | Sacripante et al. |
| 6,780,560 | B2 | 8/2004 | Farrugia et al. |
| 6,818,723 | B2 | 11/2004 | Sacripante |
| 6,826,944 | B1 | 12/2004 | Hagel |
| 6,830,860 | B2 | 12/2004 | Sacripante et al. |
| 6,849,371 | B2 | 2/2005 | Sacripante et al. |
| 7,208,253 | B2 | 4/2007 | Mayer et al. |
| 7,329,476 | B2 | 2/2008 | Sacripante et al. |
| 7,402,371 | B2 | 7/2008 | Sacripante et al. |
| 7,416,827 | B2 | 8/2008 | Farrugia et al. |
| 7,425,398 | B2 | 9/2008 | Nosella et al. |
| 7,442,740 | B2 | 10/2008 | Patel et al. |
| 2008/0107989 | A1 | 5/2008 | Sacripante et al. |
| 2008/0236446 | A1 | 10/2008 | Zhou et al. |

* cited by examiner

*Primary Examiner* — Hoa Le
(74) *Attorney, Agent, or Firm* — MDIP LLC

(57) ABSTRACT

Embodiments include a toner having a) a polyester resin derived from a naphthalenic material, a 2-alkyl succinic material, and 2,2-ethyl-butyl-1,3-propanediol, b) a wax, and c) an optional colorant.

20 Claims, No Drawings

TONER HAVING POLYESTER RESIN

BACKGROUND

The present disclosure is generally related to toners comprising polyester resins, and in embodiments, to toners made by emulsion aggregation (EA) and coalescence processes. The toners herein, in embodiments, are environmentally friendly, as they do not use the endocrine disruptor Bisphenol A. The toners herein, in embodiments, provide improved carbon/oxygen ratios. In addition, the toners herein, in embodiments, exhibit stable charge and low relative humidity sensitivity. In embodiments, the toners comprise a wax, and are useful in oil-less fusing applications (requiring little or no fusing oil for release).

Current polyester based toners are derived from Bisphenol A monomer. Bisphenol-A has been identified as an endocrine disrupter resulting in adverse developmental health effects. Several European Countries, as well as Canada and several U.S. states have targeted the ban for Bisphenol A.

Toners that do not use bisphenol-A polyester resins are known, such as those derived from aliphatic glycols and terephthalic acids. Although these resins may provide the suitable fusing performance, the toners display poor electrical performances due to their hydrophilic nature. As a design rule for obtaining good electrical performance, a successful model that has been used in polyester resins, is to calculate the carbon/oxygen (C/O) ratio of the resin. For example, known toners using Bisphenol A and/or styrene based resins have been shown to have a C/O ratio of from about 4.2 to about 4.95. These toners show stable charge and low RH sensitivity. Previous designs using terephthalic-glycol based resins showed a C/O ratio of from about 2.75 to about 3, and displayed poor electrical and RH sensitivity results. Therefore, it is desirable that the C/O ratio of polyester resins be at least 4.0 or greater, or 4.2 or greater, in embodiments from about 4.2 to about 5.5, to result in stable charge and low RH sensitivity similar to that of styrene-based resins.

Thermal properties are a necessary part of the design of a suitable toner. Toners should be designed to help prevent the occurrence of "hot offset." The resin useful in the toner should be amorphous, in embodiments, with a glass transition temperature ranging from about 50° C. to about 65° C., in embodiments from about 52° C. to about 60° C. The softening point, as measured by Mettler Softening point apparatus, should be desirable ranges for high gloss application, or for matte applications.

Illustrated in U.S. Patent Application Publication No. 2008/0236446, the disclosure of which is incorporated herein by reference in its entirety, are toner preparation processes, and more specifically, a process for the preparation of toner including i) generating an emulsion including water and resin containing from about 5 to about 70 percent solids of amorphous polyester resin particles with a particle diameter size of from about 50 to 250 nanometers; (ii) generating an emulsion of crystalline polyester resin particles with a particle diameter size of from about 50 to about 250 nanometers; (iii) aggregating said resulting mixture of amorphous polyester resin particles, crystalline polyester resin particles, and colorant including from about 25 to about 45 weight percent solids dispersion and wax dispersion with a coagulant at a pH of from about 2.5 to about 4, which pH is achieved with a dilute acid, and shearing the resulting mixture with a homogenizer at from about 2,000 to about 10,000 rpm; and (iv) subsequently heating the mixture to a temperature of from about 40° C. to about 55° C. to thereby generate toner aggregates of from about 3 to about 9 microns in diameter; followed by freezing said aggregate size by the addition of alkaline base at a pH of from about 6.3 to about 9, and adding a metal sequestering agent; heating the resulting aggregate composite to a temperature below the onset melting point of the crystalline resin to enable coalescence; decreasing the pH of the mixture from about 5.7 to about 6.3 with an acid or buffer to coalesce the toner components; and thereafter cooling, washing, isolating, and drying the toner product.

Emulsion/aggregation/coalescence processes for the preparation of toners are illustrated in a number of Xerox patents, the disclosures of each of which are incorporated herein by reference in their entirety, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210; 5,994,020; 6,020,101; 6,130,021; 6,120,967 and 6,628,102, 6,664,015, 6,780,560, 6,818,723, 6,824,944, 6,830,860, 6,849,371, 7,208,253, 7,329,476, 7,402,371, 7,416,827 7,425,398, and 7,442,740.

In addition, the following U.S. patents relate to emulsion aggregation processes of forming toner compositions, the disclosures of each of which are totally incorporated herein by reference in their entirety.

U.S. Pat. No. 5,593,807 describes processes for the preparation of toner compositions including: (i) preparing an emulsion latex comprised of sodio sulfonated polyester resin particles of from about 5 to about 500 nanometers in size diameter by heating said resin in water at a temperature of from about 65° C. to about 90° C.; (ii) preparing a pigment dispersion in a water by dispersing in water from about 10 to about 25 weight percent of sodio sulfonated polyester and from about 1 to about 5 weight percent of pigment; (iii) adding the pigment dispersion to a latex mixture including sulfonated polyester resin particles in water with shearing, followed by the addition of an alkali halide in water until aggregation results as indicated by an increase in the latex viscosity of from about 2 centipoise to about 100 centipoise; (iv) heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally (v) cooling the product mixture to about 25° C. and followed by washing and drying.

U.S. Pat. No. 7,402,371 describes a method for forming a low melt toner, the method including: forming a pre-toner mixture including (i) an emulsion resin including a first alkali sulfonated polyester resin and a second alkali sulfonated polyester resin, (ii) a colorant, and (iii) optionally a wax; adjusting the pH of the pre-toner mixture to between about 4 to about 5; homogenizing the pre-toner mixture; forming an aggregate mixture of aggregate toner particles by adding an aggregating agent over a period of from about 10 to about 60 minutes; adjusting the pH of the aggregate mixture to between about 5 and about 7; heating the aggregate mixture to a temperature of from about 50° C. to about 80° C. thereby forming a mixture coalesced toner particles; controlling toner particle size by adjusting the pH of the mixture of coalesced toner particles to between about 5 and about 7; and cooling the mixture of coalesced toner particles to room temperature.

Illustrated in U.S. Patent Application Publication No. 2008/0107989 is a process for forming particles, including forming a latex by generating an emulsion of a polyester resin initially having an acid value of from about 16 mg/eq KOH to 40 mg/eq KOH; optionally adding thereto a colorant dispersion, a wax dispersion, and/or a surfactant; shearing and adding an aqueous solution of acid until the pH of the mixture is from about 3 to about 5.5, followed by optionally adding an aqueous solution of coagulant; heating to a temperature of from about 30° C. to about 60° C., wherein the aggregate grows to a size of from about 3 to about 20 microns; raising the pH of the mixture to from about 7 to about 9; heating the mixture to about 60° C. to about 95° C.; and optionally decreasing the pH to a range of about 6 to about 6.8.

Therefore, it is desired to provide a toner having a polyester resin, which is not derived from the endocrine disruptor Bisphenol-A. It is further desired to provide a polyester resin toner which has a suitable glass transition temperature, softening point, C/O ratio, improved electrical characteristics, and RH sensitivity. In addition, it is desired to provide a toner that can be used in an oil-less fusing system, requiring little or no fusing oil.

SUMMARY

The present disclosure provides toners and methods for their production. In embodiments, a toner of the present disclosure may include a polyester resin derived from a napthalenic material, 2,2-ethyl-butyl-1,3-propanediol and 2-alkyl succinic material; a wax; and an optional colorant.

In embodiments, a toner of the present disclosure may include a polyester resin derived from a naphthalenic material in an amount of from about 0.3 to about 0.52 mole percent, a 2-alkyl succinic material present in an amount of from about 0 to about 0.2 mole percent, and 2,2-ethyl-butyl-1,3-propanediol in an amount of from about 0.48 to about 0.50 mole percent; a wax; and a colorant.

In yet other embodiments, a toner of the present disclosure may include a polyester resin derived from 2,6 napthalene dicarboxylic acid, 2,2-ethyl-butyl-1,3-propanediol, and 2-dodecylsuccinic acid; a wax; and a colorant, wherein said carbon/oxygen ratio of said polyester resin is from about 4 to about 9.

DETAILED DESCRIPTION

In embodiments, there is disclosed toners including polyester resins, and in embodiments, toners made by conventional methods such as melt polycondensation as well as emulsion aggregation (EA) and coalescence processes. The toners herein, in embodiments, are environmentally friendly, as they do not use the endocrine disrupter Bisphenol A. The resins herein, in embodiments, provide improved carbon/oxygen ratios. In addition, the toners herein, in embodiments, exhibit stable charge and low relative humidity sensitivity. In embodiments, the toners comprise a wax, and are useful in oil-less fusing applications (requiring little or no fusing oil for release). The toners herein comprise wax, an optional colorant, and a polyester resin derived from napthalenic material, a 2-alkyl succinic material, and a diol, in embodiments, 2,2-ethyl-butyl-1,3-propanediol.

Imaging methods are also envisioned as part of the present disclosure, reference for example a number of the patents mentioned herein, and U.S. Pat. No. 4,265,660, the disclosure of which is totally incorporated by reference herein. Imaging processes comprise, for example, preparing an image with an electrophotographic or xerographic device comprising a charging component, an imaging component, a photoconductive component, a developing component, a transfer component, and a fusing component; and wherein the development component comprises a developer prepared by mixing a carrier with a toner composition prepared with the toner processes illustrated herein; an imaging process comprising preparing an image with an electrophotographic or xerographic device comprising a charging component, an imaging component, a photoconductive component, a developing component, a transfer component, and a fusing component; wherein the development component comprises a developer prepared by mixing a carrier with a toner composition prepared with the toner processes illustrated herein; and wherein the electrophotographic or xerographic device comprises a high speed printer, a black and white high speed printer, a color printer, or combinations thereof.

In embodiments, by use of the toner described herein, in embodiments, the electrostatographic apparatus that the toner is used with can be an oil-less apparatus, thereby decreasing or dispensing with the need for fuser oil. This cuts down on costs by reducing the need, or eliminating the need, for costly fuser oils.

Resin

The toner herein comprises a resin. The resin herein can be present in various effective amounts, such as from about 70 weight percent to about 98 weight percent, and more specifically, about 80 weight percent to about 92 weight percent based upon the total weight percent of the toner.

In embodiments, the resin may be derived from a napthalenic material, a 2-alkyl succinic material (including acids, diesters, and anhydrides thereof), and a diol.

Suitable napthalenic materials include, for example, 2,6 napthalene dicarboxylic acid, dimethyl 2,6-napthalene dicarboxylate, diethyl 2,6-napthalene dicarboxylate, dipropyl 2,6-napthalene dicarboxylate, di-isopropyl 2,6-napthalene dicarboxylate, dibutyl 2,6-napthalene dicarboxylate, and combinations thereof.

Suitable 2-alkyl succinic materials include, for example, 2-ethyl succinic acid, 2-propyl succinic acid, 2-butyl succinic acid, 2-pentyl succinic acid, 2-hexyl succinic acid, 2-heptyl succinic acid, 2-octyl succinic acid, 2-dodecylsuccinic acid, 2-octadecyl succinic acid, as well as diesters and anhydrides thereof, and combinations thereof.

Suitable diols for forming the resin may include 2-butyly-ethyl-1,3-propanediol, ethylene glycol, propylene glycol, combinations thereof, and the like.

The above resin may thus be utilized to form polyester toner particles. General polyester toner particles created by the emulsion/aggregation (EA) process are illustrated in a number of patents, such as U.S. Pat. No. 5,593,807, U.S. Pat. No. 7,402,371, U.S. Patent Application Publication Nos. 2008/0107989 and 2008/0236446, the disclosures of each of which are incorporated herein by reference in their entirety. As these references fully describe EA toners and methods of making the same, further discussion on these points is omitted herein. Below is set forth specific methods on making the particular polyester resin described herein.

The toner resin of the present disclosure may be prepared via a melt condensation process, including heating a mixture of organic diacid or diester such as dimethyl 2,6-napthalene dicarboxylate (or 2,6-naphthalene dioic acid) and 2-dodecyl succinic acid (or anhydride), with an organic diol such as 2,2-ethyl-butyl-1,3-propanediol, and an with a condensation catalyst such as tin oxide or butyl-stannoic acid, to a temperature of about 160° C. to about 220° C. wherein water or methanol byproduct is distilled, followed by polymerization at from about 190° C. to about 250° C. under reduced pressure of from about 0.01 to about 10 Torr, followed by discharging the content and cooling the resin product to room temperature. The polymeric resin, in preferred embodiments, display a glass transition temperature of from about 50° C. to about 62° C., a number average molecular weight of about 1000 to about 20,000 grams per mole, and a weight average molecular weight of from about 4,000 to about 250,000 grams per mole.

The toners herein comprise a polyester resin derived from dimethyl 2,6-napthalene dicarboxylolate (or 2,6-naphthalene dioic acid), 2-dodecyl succinic acid (or anhydride) and 2,2-ethyl-butyl-1,3-propanediol. In one embodiment, the polyester resin can be prepared by a melt polycondensation process known in the art, and wherein a slight stoichiometric excess in balance of diacid to diol, for example, the 2,6-napthalene dicarboxylic acid or dimethyl 2,6-napthalene dicarboxylolate and 2-dodecyl succinic acid (or anhydride), is utilized in excess relation to the diol, such as from about 0.30 to about 0.52 mole equivalent of dimethyl 2,6-napthalene dicarboxylolate, and from about 0.0 to about 0.20 mole equivalent of 2-dodecyl succinic acid (or anhydride), provided that the total amount of dimethyl 2,6-napthalene dicarboxylolate (or 2,6-naphthalene dioic acid), and 2-dodecyl succinic acid (or anhydride) is from about 0.50 to about 0.52 mole equivalent, and the organic diol is from about 0.48 to about 0.50 mole equivalent of diol comprising the 2,2-butyly-ethyl-1,3-propanediol. The slight excess of diester/di-acid (or anhydride), ensures that the resulting polyester resin is terminated with acidic end group moieties, such that a resin acid number of from about 8 to about 20 meq/KOH is obtained.

More specifically, the polyester can be obtained by charging a one liter Parr reactor equipped with a bottom drain valve, double turbine agitator and distillation receiver with a cold water condenser with from about 0.45 mole equivalent of the 6-napthalene dicarboxylic acid, from about 0.06 mole equivalent of 2-dodecyl succinic acid (or anhydride), hence the combined diacid is utilized in an amount of from about 0.51 mole equivalent, with a from about 0.49 mole equivalent of 2,2-butyly-ethyl-1,3-propanediol. A polycondensation catalyst in an amount of from about 0.001 to about 0.01 mole equivalent is also added, such as tetrabutyl titanate or butylstannoic acid.

The reactor is then heated to from about 190° C. to about 220° C. with stirring for a duration of from about 3 hours to about 6 hours, whereby 0.5 to about 1 mole of water is collected in the distillation receiver. The mixture is then heated at from about 180° C. to about 210° C., after which the pressure is slowly reduced over from about a 10 minute to about a 3 hour period to from about 100 Torr to about 30 Torr, and then reduced to from about 0.01 Torr to about 5 Torr over a period of from about one hour to about 5 hours with a collection of more water. The reactor is then purged with nitrogen to atmospheric pressure and the contents discharged through the bottom drain valve and cooled to room temperature.

The resulting resin displays a glass transition temperature of from about 52° C. to about 65° C., an acid number of from about 5 to about 20 meq/KOH, a number average molecular weight of from about 1,000 to about 10,000 grams per mole, a weight average molecular weight of from about 3,000 to about 100,000 grams per mole, and a softening point of from about 105° C. to about 150° C. The polyester structure can be represented by the following formula;

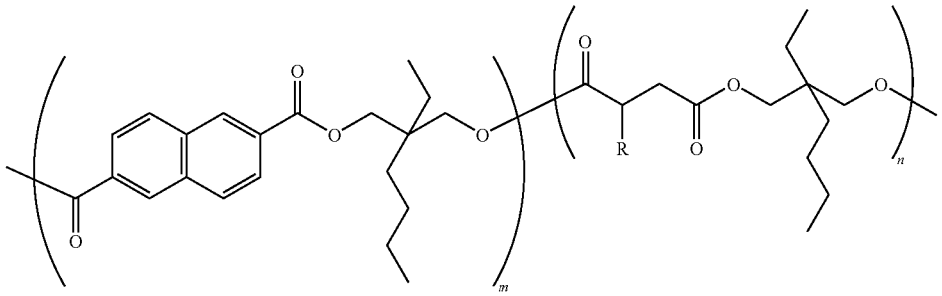

wherein R is a hydrocarbon possessing from about 2 to about 21 carbon atoms, and m and n represent the segments of the polyester resin structure and are randomly distributed. In embodiments, segment m may be from about 1 to about 10, and segment n may be from about 90 to about 99, provided that the sum of m and n is 100.

In other embodiments, the polyester resin of this invention can be prepared by a melt polycondensation process known in the art, and wherein a diester is utilized, such as Dimethyl 2,6-Napthalene dicarboxylolate with 2-dodecyl succinic acid (or anhydride), with an excess of 2,2-butyly-ethyl-1,3-propanediol is utilized for the trans-esterification and subsequently removed during polymerization. In such process, an excess amount of the diol is utilized such as from about 0.5 to 1 mole equivalent excess and subsequently this excess diol is removed from the polycondensation reaction. Note, however, that the resulting polyester resin has hydroxyl moieties as end groups, and thus may lack the necessary acid number for use as a functional toner. However, the aforesaid resin with hydroxyl end groups can be then transformed to acidic end groups by reaction with multifunctional acids or anhydrides as disclosed in U.S. Pat. No. 5,686,218, the disclosure of which is hereby incorporated by reference in its entirety.

More specifically, the polyester can be obtained by charging a one liter Parr reactor equipped with a bottom drain valve, double turbine agitator and distillation receiver with a cold water condenser with about 0.45 mole equivalent of the dimethyl 2,6-napthalene dicarboxylolate, 0.05 mole equivalent 2-dodecyl succinic acid (or anhydride) and from about 0.95 to about 1.05 mole equivalent of 2,2-butyly-ethyl-1,3-propanediol, in which the provided diol is utilized in an excess amount of from about 0.45 to about 0.55 mole equivalent, and a polycondensation catalyst in an amount of from about 0.001 to about 0.01 mole equivalent is also added, such as tetrabutyl titanate or butylstannoic acid. Note that the excess diol, of from about 0.45 to about 0.55 mole equivalent, does not necessarily have to be 2,2-butyly-ethyl-1,3-propanediol, and in embodiments can be ethylene glycol or propylene glycol, which have lower boiling points of from about 185° C. to 195° C. as compared to the 2,2-butyly-ethyl-1,3-propanediol, and which can be removed during the polycondensation reaction. The reactor is then heated to from about 160° C. to about 190° C. with stirring for a duration of from about 3 hours to about 6 hours and whereby 0.3 to about 0.45 mole of methanol is collected in the distillation receiver.

The mixture is then heated at from about 190° C. to about 220° C., and after which the pressure is slowly reduced over a period of from about 10 minutes to about 3 hours to from about 100 Torr to about 30 Torr, and then reduced to from about 0.01 Torr to about 5 Torr over a period of from about one hour to about 5 hours, with a collection of methanol and the excess glycol in an amount of from about 0.40 to about 0.5 mole equivalent.

The reactor is then purged with nitrogen to atmospheric pressure and to this is added the multifunctional acid or anhydride such as trimellitic anhydride in an amount of from about 0.01 to about 0.05 mole equivalent, to provide with acidic end groups. The mixture is then heated from a temperature of from about 160° C. to about 190° C. for a duration of from about 0.5 to about 2 hours. The reactor is then purged with nitrogen to atmospheric pressure and the contents discharged through the bottom drain valve and cooled to room temperature.

The resulting resin displays a glass transition temperature of from about 52° C. to about 65° C., an acid number of from about 5 to about 20 meq/KOH, a number average molecular weight of from about 1,000 to about 10,000 grams per mole, a weight average molecular weight of from about 3,000 to about 100,000 grams per mole, and a softening point of from about 105° C. to about 150° C., in embodiments from about 110° C. to about 130° C.

The polyester structure can be represented by the following formula:

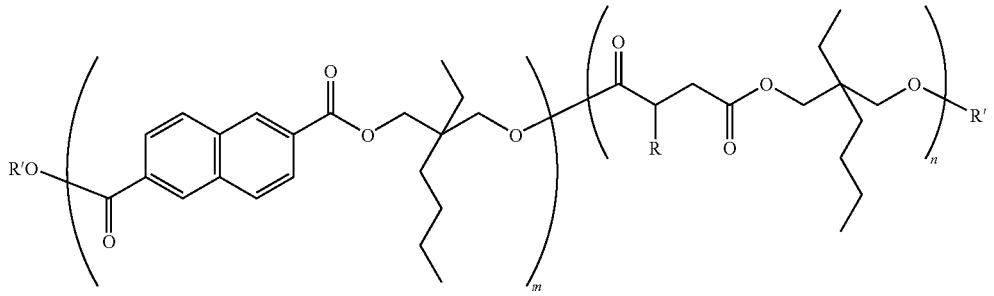

wherein R is a hydrocarbon of from about 2 to about 21 carbon atoms; and m and n represent the segments of the polyester resin structure and are randomly distributed. In embodiments, segment m may be from about 1 to about 10, and segment n may be from about 90 to about 99, provided that the sum of m and n is 100 percent. R' may be an acidic moiety represented as;

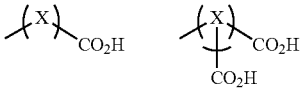

wherein X is an aryl or aliphatic moiety having from about 2 to about 18 carbon atoms.

Specific examples of organic anhydrides or acid anhydrides which may be utilized for converting the polyester resin with hydroxyl end groups to polyester resins with acid end groups (which may be referred to, in embodiments, as end capping with an acid) include, for example, phthalic anhydride, trimellitic anhydride, succinic anhydride, maleic anhydride, glutaric anhydride, 1,2,4,5-benzenedicarboxylic acid anhydride, combinations thereof, and the like, in various effective amounts of, for example, from about 0.5 percent by weight of resin to about 5 percent by weight of resin.

Specific examples of diester, diacid and/or anhydride component for making the polyester resins can include, for example, 2,6 napthalene dicarboxylic acid, dimethyl 2,6-napthalene dicarboxylate, diethyl 2,6-napthalene dicarboxylate, dipropyl 2,6-napthalene dicarboxylate, di-isopropyl 2,6-napthalene dicarboxylate, dibutyl 2,6-napthalene dicarboxylate, 2-ethyl succinic acid, 2-propyl succinic acid, 2-butyl succinic acid, 2-pentyl succinic acid, 2-hexyl succinic acid, 2-heptyl succinic acid, 2-octyl succinic acid, 2-dodecyl-succinic acid, 2-octadecyl succinic acid, as well as the diesters or anhydrides thereof.

The use of the above polyester resin allows for superior C/O ratio of greater than about 4, or greater than about 4.2, or greater than about 4.4, or from about 4 to about 9, or from about 4.2 to about 8, or from about 4.4 to about 7.5, or from about 4 to about 5, or from about 4.2 to about 4.5, or from about 4.4 to about 5. The carbon to oxygen ratio can be easily calculated utilizing the formula;

$$C/O=\Sigma(C_i/O_i)$$

wherein C/O is the carbon to oxygen ratio, Ci is the sum of carbon atoms present in the resin, and Oi is the sum of the oxygen atom present in the resin.

The polyester resin herein is amorphous, and has a glass transition temperature of from about 50° C. to about 65° C., or from about 52° C. to about 60° C.

The polyester resin herein has a softening point, as measured by Mettler Softening point apparatus, of from about 105 to about 115° C., or from about 108 to about 112° C. for high gloss applications; or greater than about 108° C., or from about 108 to about 150° C., or from about 120 to about 145° C. for matte applications. A Shimadzu Flowtester for other similar parameters such as Tfl can be used instead of softening point. Rheology can be used to measure Gloss correlation, and to some extent, for Crease MFT.

The polyester resin herein has a weight average molecular weight (Mw) of from about 5,000 to about 25,000, or from about 6,000 to about 20,000; and a number average molecular weight (Mn) of from about 2,000 to about 12,000, or from about 3,000 to about 10,000.

The polyester resin may include of from about 0.30 to about 0.52 mole equivalent of the naphthalenic material, for example 2,6-Napthalene dicarboxylolate, from about 0 mole to about 0.20 mole equivalent of the 2-alkyl succinic material, for example 2-dodecyl succinic acid, and from about 0.48 to about 0.5 mole equivalent of the diol material, for example 2,2-butyly-ethyl-1,3-propanediol, provided that the resin includes about 1 mole equivalent of the aforesaid monomers.

Specific examples of polycondensation catalysts are within the purview of those skilled in the art and can include tetraalkyl titanates, dialkyltin oxide, tetraalkyltin, dialkyltin oxide hydroxide, aluminum alkoxides, alkyl zinc, dialkyl zinc, zinc oxide, stannous oxide, dibutyltin oxide, butyltin oxide hydroxide, tetraalkyl tin, butyl stannoic acid, such as dibutyltin dilaurate, and mixtures thereof, and these catalysts are selected in various effective amounts of, for example, from about 0.01 mole percent to about 1 mole percent of polyester product resin.

Wax

The toners herein comprise a wax. The wax has an onset temperature of from about 50° C. to about 70° C., and an offset temperature of from about 95° C. to about 100° C., during the heat up cycle (i.e., melting), as measured by a DSC when the heating rate is 10° C./min.

The needle penetration point of the wax is from about 0.1 to about 10, or from about 0.5 to about 8, or from about 1 to about 5 dmm (decimillimeter). The needle penetration point can be measured in accordance with ASTM 1321, using K95500 Koehler Instruments digital penetrometer, or can be measured in other known ways.

The wax in a toner material is present, for example, in an amount of from about 5 to about 30 percent by weight, or from about 7 to about 20 percent by weight, based upon the total weight of the composition.

Examples of waxes include those as illustrated herein, such as those of the aforementioned co-pending applications, polyolefins such as polypropylenes, polyethylenes, and the like, such as those commercially available from Allied Chemical and Baker Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Examples of functionalized waxes include amines, amides, for example AQUA SUPERSLIP 6550™, SUPERSLIP 6530™ available from Micro Powder Inc.; fluorinated waxes, for example POLYFLUO 190™, POLYFLUO 200™, POLYFLUO 523XF™, AQUA POLYFLUO 411™, AQUA POLYSILK 19™, POLYSILK 14™ available from Micro Powder Inc.; mixed fluorinated, amide waxes, for example MICROSPERSION 19™ also available from Micro Powder Inc.; imides, esters, quaternary amines, carboxylic acids or acrylic polymer emulsion, for example JONCRYL 74™, 89™, 130™, 537™, and 538™, all available from SC Johnson Wax; chlorinated polypropylenes and polyethylenes available from Allied Chemical and Petrolite Corporation, and from SC Johnson Wax. Such waxes can optionally be fractionated or distilled to provide specific cuts that meet viscosity, temperature criteria wherein the upper limit of viscosity is 10,000 cps and the temperature upper limit is 100° C. can be used.

In embodiments, the wax comprises a wax in the form of a dispersion comprising, for example, a wax having a particle diameter of about 100 nanometers to about 500 nanometers or about 100 nanometers to about 300 nanometers, water, and an anionic surfactant or a polymeric stabilize, and optionally a nonionic surfactant. In embodiments, the wax comprises polyethylene wax particles, such as POLYWAX® 655, or POLYWAX® 725, POLYWAX® 500 (the POLYWAX® waxes being commercially available from Baker Petrolite) and, for example, fractionated/distilled waxes which are cuts of commercial POLYWAX® 655 designated here as X1214, X1240, X1242, X1244, and the like, but are not limited to POLYWAX® 655 cuts. Waxes providing a specific cut, that meet the viscosity/temperature criteria, wherein the upper limit of viscosity is 10,000 cps and the temperature upper limit is 100° C. can be used. The waxes can have a particle diameter in the range of from about 100 to about 500 nanometers, although not limited. Other examples include FT-100 waxes from Shell (SMDA), and FNP0092 from Nippon Seiro. The surfactant used to disperse the wax can be an anionic surfactant, although not limited thereto, such as, for example, Neogen RK® commercially available from Daiichi Kogyo Seiyaku or TAYCAPOWER® BN2060 commercially available from Tayca Corporation or Dowfax available from DuPont.

In embodiments, the wax has an onset melt temperature of from about 65° C. to about 75° C., or from about 95° C. to about 100° C.

In embodiments, the wax has a Mn, Mw and Mp, and each and all may fall within the ranges of from about 500 to about 800, or from about 600 to about 750, or from about 640 to about 725. The wax has a polydispersity (Mw/Mn) of from about 1 to about 1.05.

Colorant

The toner herein may comprise a colorant. Suitable colorants include pigments, dyes, mixtures of pigments and dyes, mixtures of pigments, mixtures of dyes, and the like. In embodiments, the colorant comprises carbon black, magnetite, black, cyan, magenta, yellow, red, green, blue, brown, mixtures thereof, selected for example, in an amount of from about 1 to about 25 percent by weight based upon the total weight of the composition.

Colorants can be selected in the form of a pigment dispersion comprising pigments particles having a size in the range of from about 50 to about 500 nanometers, water, and an anionic surfactant or polymeric stabilizer.

In some instances, pigments are available in the wet cake or concentrated form containing water, and can be easily dispersed utilizing a homogenizer, or simply by stirring, ball milling, attrition, or media milling. In other instances, pigments are available only in a dry form, whereby dispersion in water is effected by microfluidizing using, for example, a M-110 microfluidizer or an Ultimizer and passing the pigment dispersion from about 1 to about 10 times through the chamber, or by sonication, such as using a Branson 700 sonicator, or a homogenizer, ball milling, attrition, or media milling with the optional addition of dispersing agents such as the aforementioned ionic or nonionic surfactants. In the instance of preparing carbon black pigment or other pigment dispersion, the above techniques can also be applied in the presence of a surfactant.

Specific colorants that may be used include, Paliogen Violet 5100 and 5890 (BASF), Normandy Magenta RD-2400 (Paul Ulrich), Permanent Violet VT2645 (Paul Ulrich), Heliogen Green L8730 (BASF), Argyle Green XP-111-S (Paul Ulrich), Brilliant Green Toner GR 0991 (Paul Ulrich), Lithol Scarlet D3700 (BASF), Toluidine Red (Aldrich), Scarlet for Thermoplast NSD Red (Aldrich), Lithol Rubine Toner (Paul Ulrich), Lithol Scarlet 4440, NBD 3700 (BASF), Bon Red C (Dominion Color), Royal Brilliant Red RD-8192 (Paul Ulrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Ulrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Ulrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL® 330 (Cabot), Carbon Black 5250 and 5750 (Columbian Chemicals), and the like or mixtures thereof.

Additional useful colorants include pigments in water-based dispersions such as those commercially available from Sun Chemical, for example SUNSPERSE BHD 6011 (Blue 15 Type), SUNSPERSE BHD 9312 (Pigment Blue 15), SUNSPERSE BHD 6000 (Pigment Blue 15:3 74160), SUNSPERSE GHD 9600 and GHD 6004 (Pigment Green 7 74260), SUNSPERSE QHD 6040 (Pigment Red 122), SUNSPERSE RHD 9668 (Pigment Red 185), SUNSPERSE RHD 9365 and 9504 (Pigment Red 57, SUNSPERSE YHD 6005 (Pigment Yellow 83), FLEXIVERSE YFD 4249 (Pigment Yellow 17), SUNSPERSE YHD 6020 and 6045 (Pigment Yellow 74), SUNSPERSE YHD 600 and 9604 (Pigment Yellow 14), FLEXIVERSE LFD 4343 and LFD 9736 (Pigment Black 7) and the like or mixtures thereof. Other useful water-based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Ulrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra(octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan components may also be selected as pigments.

Other Additives

Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 2 weight percent, reference U.S. Pat. Nos. 3,590,000, 3,720,617, 3,655,374 and 3,983,045, the disclosures of which are totally incorporated herein by reference. Examples of suitable additives include zinc stearate and AEROSIL R972® available from Degussa in amounts of from about 0.1 to about 2 percent which can be added during the aggregation process or blended into the formed toner product.

Also provided herein are developer and imaging processes, including a process for preparing a developer comprising preparing a toner composition with the toner processes illustrated herein and mixing the resulting toner composition with a carrier. Developer compositions can be prepared by mixing the toners obtained with the processes of the present disclosure with known carrier particles, including coated carriers, such as steel, ferrites, and the like, reference U.S. Pat. Nos. 4,937,166 and 4,935,326, the disclosures of which are totally incorporated herein by reference, using, for example from about 2 to about 8 percent toner concentration. The carriers selected may also contain dispersed in the polymer coating a conductive compound, such as a conductive carbon black and which conductive compound is present in various suitable amounts, such as from about 15 to about 65, or from about 20 to about 45 weight percent by weight of total solids.

The size of the toner particles can be, for example, from about 1 to about 25 microns, from about 3 microns to about 9 microns, more specifically, from about 4 microns to about 6 microns or about 5 microns.

The following Examples are being submitted to further define various species of the present disclosure. These Examples are intended to be illustrative only and are not intended to limit the scope of the present disclosure. Also, parts and percentages are by weight unless otherwise indicated.

EXAMPLES

Example 1

Synthesis of a polyester resin derived from 0.5 mole equivalent of dimethyl 2,6-naphthalene dicarboxylate, 0.5 mole equivalent of 2,2-ethyl-butyl-1,3-propanediol and wherein the resin is end capped with 0.02 mole equivalent of trimellitic anhydride.

A 2 liter reactor equipped with a mechanical stirrer and bottom drain valve was charged with about 318.5 grams of 2,6-dimethyl naphthalene dicarboxylate, about 208 grams of 2,2-ethyl-butyl-1,3-propanediol, about 104 grams of propylene glycol (excess glycol), and about 0.5 grams of butylstannoic acid. The reactor was then heated to from about 165° C. to about 185° C., gradually over a 3 hour period, and then maintained at about 185° C. for an additional 3 hours. During this time, the byproduct (methanol) was collected in the distillation receiver. The temperature was then increased to about 210° C., and the pressure reduced gradually from atmospheric pressure to about 0.5 Torr over a two hour period. During this time, the excess propylene glycol was collected in the distillation receiver. The reaction conditions were maintained for an additional 90 minutes, after which the reactor was pressurized to atmospheric pressure with nitrogen.

To the mixture in the reactor was added about 10 grams of trimellitic anhydride and the reaction was stirred at about 165° C. for an additional 60 minutes, after which the product was discharged through the bottom drain valve of the reactor to yield the resin product. This resin product was characterized as possessing a glass transition temperature of about 60° C. as measured by a DuPont differential scanning calorimeter, a softening point of about 139° C. as measured with a Mettier cell point apparatus, a number average molecular weight of about 4,200 grams per mole, a weight average molecular weight of about 10,000 grams per mole, as measured by gel permeation chromatography using polystyrene as the standard and tetrahydrofuran as the solvent, and an acid number of 15 milligram of potassium hydroxide per gram of resin.

Examples 2 to 5

A series of polyesters were prepared utilizing the same procedure as Example 1, with 2-Dodecylsuccinic anhydride (DSA) was included in the reaction: the varying amounts of the monomer compositions utilized to form the resins and their resulting properties are set forth below in Table 1:

TABLE 1

Polyester Resins

| | Monomers | | | | Tg | Ts | GPC (/1000) | |
|---|---|---|---|---|---|---|---|---|
| Resin | NDC | BEG | DSA | C/O | ° C. | ° C. | Mn | Mw |
| Example 1 | 0.5 | 0.5 | 0 | 5.25 | 60 | 139 | 4.2 | 10 |
| Example 2 | 0.45 | 0.5 | 0.05 | 5.35 | 56.7 | 131 | 4.9 | 13 |
| Example 3 | 0.45 | 0.5 | 0.10 | 5.35 | 51.4 | 121 | 3.8 | 8.9 |
| Example 4 | 0.45 | 0.5 | 0.15 | 5.35 | 54.8 | 128 | 4.6 | 11.9 |
| Example 5 | 0.45 | 0.5 | 0.05 | 5.35 | 52.2 | 127 | 4.6 | 11.3 |

NDC = Dimethyl 2,6-Naphthalene Dicarboxylate;
BEG = 2,2-ethyl-butyl-1,3-propanediol;
DSA = 2-Dodecylsuccinic anhydride
C/O = Carbon to Oxygen ratio;
Tg = glass transition temperature;
Ts = softening point;
GPC = Gel Permeation Chromatography;
Mn = number average molecular weight;
Mw = weight average molecular weight

Example 6

Preparation of a conventional toner including about 95 percent by weight of the polyester resin of Example 2, and about 5 percent by weight of Regal 330 carbon black pigment.

About 380 grams of the polyester resin of Example 2 was mixed with about 20 grams of Regal 330 carbon black available from Cabot Corporation (about 5 percent by weight of toner). The two components were dry blended first on a paint shaker and then on a roll mill. A small DAVO™ counter rotating twin screw extruder was then used to melt mix the aforementioned mixture. A K-Tron twin screw volumetric feeder was used to feed the mixture to the extruder with a barrel temperature of about 120° C., a screw rotational speed of about 60 rpm, at a feed rate of about 10 grams per minute.

The extruded strands were broken into coarse particles by passing through a Model J Fitzmill twice, the first time with an 850 micrometer screen, and the second time with a 425 micrometer screen. An 8 inch Sturtevant micronizer was used to reduce the particle size further. After grinding, the toner was measured to display an average volume diameter particle size of about 7 microns, with a geometric distribution of about 1.35 as measured by a Coulter Counter.

A Developer was prepared by mixing the above toner with a 65 micron Hoaganese steel core coated with about 1 percent by weight of a composite of a polymer of PMMA (polymethylmethacrylate with the conductive carbon black, CONDUCTEX SC ULTRA®, dispersed therein, about 20 weight percent).

Triboelectric data was obtained using the known blow-off Faraday Cage apparatus, and the charge was measured to be about −25 microcoulombs per gram. Unfused copies were then produced using a Xerox Modified printer with the fusing system disabled. The unfused copies were then subsequently fused on a customized test fuser using a process speed of about 11.9 inches per second. Fusing evaluation of the toner indicated a minimum fixing temperature of about 160° C. and hot-offset temperature of about 210° C.

Example 7

Preparation of an emulsion aggregation toner including about 98 percent by weight of the polyester resin of Example 3, and about 2 percent by weight of a cyan pigment PB15:3.

About 125 grams of the polyester resin of Example 3 was measured into a 2 liter beaker containing about 917 grams of ethyl acetate. The mixture was stirred at about 250 revolutions per minute and heated to about 65° C. to dissolve the resin in the ethyl acetate.

About 3 grams of sodium bicarbonate was measured into a 4 liter Pyrex glass flask reactor containing about 700 grams of deionized water and heated to about 65° C. Homogenization of the heated water solution in the 4 liter glass flask reactor commenced with an IKA Ultra Turrax T50 homogenizer operating at about 4,000 revolutions per minute.

The heated dissolved resin in ethyl acetate was then slowly poured into the water solution as the mixture continued to be homogenized, with the homogenizer speed increased to about 10,000 revolutions per minute and homogenization carried out at these conditions for about 30 minutes. At completion of homogenization, the glass flask reactor and its contents were placed in a heating mantle and connected to a distillation device. The mixture was stirred at about 400 revolutions per minute and the temperature of the mixture was increased to about 80° C. at about 1° C. per minute to distill off the ethyl acetate from the mixture. Stirring of the mixture continued at about 80° C. for about 120 minutes followed by cooling at about 2° C. per minute to room temperature.

The product was screened through a 20 micron sieve and the pH was adjusted to about 7 with the addition of about 1 Normal sodium hydroxide. The resulting polyester resin emulsion included about 20% by weight solids in water as measured gravimetrically, and had a volume average diameter of about 205 nanometers as measured with a HONEYWELL MICROTRAC® UPA150 particle size analyzer.

A 2 liter kettle, equipped with a mechanical stirrer and heating mantle, was charged with about 490 grams of the aforesaid aqueous mixture including about 20 percent by weight of polyester resin particles, about 260 grams of water, about 4.5 grams of TAYCAPOWER BN2060 anionic surfactant (an aqueous solution of 17.5 per cent solids by weight, available from Tayca Corporation), and about 11.76 grams of a pigment dispersion including about 17 per cent by weight of Pigment Blue 15:3 cyan pigment was added thereto, such that a total of about 2 percent by weight of pigment in the toner was utilized. The mixture was homogenized at about 2,000 revolutions per minute, followed by the drop wise addition of about 90 grams of a 0.3 Normal solution of nitric acid and aluminum sulfate as a coagulant. During the acid addition, the homogenization was increased to about 4,500 revolutions per minute and maintained at that speed for about 5 minutes.

The mixture was then stirred at about 175 revolutions per minute, and heated to about 36.5° C., during which time the particle composites grew to about 6 microns in diameter. The pH was then adjusted to about 8.2 by the addition of a 4% aqueous solution of sodium hydroxide, followed by heating the mixture to about 85° C. over a 2 hour period. During this time, the particle composite coalesced. The mixture was then cooled to room temperature, the toner particles filtered, washed several times with water, and followed by freeze drying to obtain the toner powder.

The resulting toner had a volume average particle size of about 5.9 microns as measured with a Coulter Counter, a circularity of about 0.97 as measured with a SYSMEX® FPIA-2100 flowtype histogram analyzer.

A developer was prepared by mixing the above toner with a 65 micron Hoaganese steel core coated with about 1 percent by weight of a composite of a polymer of PMMA (polymethylmethacrylate with the conductive carbon black, CONDUCTEX SC ULTRA®, dispersed therein, about 20 weight percent).

Triboelectric data was obtained using the known blow-off Faraday Cage apparatus, and the charge was measured to be about −21 microcoulombs per gram. Unfused copies were then produced using a Xerox Modified printer with the fusing system disabled. The unfused copies were then subsequently fused on a customized test fuser using a process speed of about 11.9 inches per second. Fusing evaluation of the toner indicated a minimum fixing temperature of about 165° C. and hot-offset temperature of about 220° C.

It will be appreciated that various of the above-discussed and other features and functions, or alternatives thereof, may be desirably combined into many other different systems or applications. Also that various presently unforeseen or unanticipated alternatives, modifications, variations or improvements therein ay be subsequently made by those skilled in the art which are also intended to be encompassed by the following claims.

What is claimed is:

1. A toner comprising:

a polyester resin derived from a napthalenic material, 2,2-ethyl-butyl-1,3-propanediol and 2-alkyl succinic material;

a wax; and an optional colorant.

2. A toner in accordance with claim 1, wherein said napthalenic material is selected from the group consisting of 2,6 napthalene dicarboxylic acid, dimethyl 2,6-napthalene dicarboxylate, diethyl 2,6-napthalene dicarboxylate, dipropyl 2,6-napthalene dicarboxylate, di-isopropyl 2,6-napthalene dicarboxylate, dibutyl 2,6-napthalene dicarboxylate, and combinations thereof.

3. A toner in accordance with claim 1, wherein said 2-alkyl succinic material is selected from the group consisting of 2-ethyl succinic acid, 2-propyl succinic acid, 2-butyl succinic acid, 2-pentyl succinic acid, 2-hexyl succinic acid, 2-heptyl succinic acid, 2-octyl succinic acid, 2-dodecylsuccinic acid, 2-octadecyl succinic acid, as well as diesters and anhydrides thereof.

4. A toner in accordance with claim 1, wherein the polyester resin is end-capped with an acid by reacting the resin with an anhydride selected from the group consisting of phthalic anhydride, trimellitic anhydride, succinic anhydride, maleic anhydride, glutaric anhydride, 1,2,4,5-benzenedicarboxylic acid anhydride.

5. A toner in accordance with claim 1, wherein the polyester resin possesses a carbon/oxygen ratio of from about 4 to about 9.

6. A toner in accordance with claim 1, wherein the polyester resin possesses a glass transition temperature of from about 50° C. to about 65° C.

7. A toner in accordance with claim 1, wherein the polyester resin possesses a glass transition temperature of from about 52° C. to about 60° C.

8. A toner in accordance with claim 1, wherein said polyester resin has a weight average molecular weight (Mw) of from about 5,000 to about 25,000.

9. A toner in accordance with claim 1, wherein said polyester resin has a number average molecular weight (Mn) of from about 2,000 to about 12,000.

10. A toner in accordance with claim 1, wherein said polyester resin has a number average molecular weight (Mn) of from about 3,000 to about 10,000.

11. A toner in accordance with claim 1, wherein said polyester resin has a softening point of from about of from about 105° C. to about 150° C.

12. A toner in accordance with claim 1, wherein said polyester resin has a softening point of from about of from about 110° C. to about 130° C.

13. A toner in accordance with claim 1, wherein said naphthalenic material is present in said toner in an amount of from about 0.3 to about 0.52 mole percent.

14. A toner in accordance with claim 1, wherein said 2-alkyl succinic material is present in said toner in an amount of from about 0 to about 0.2 mole percent.

15. A toner in accordance with claim 1, wherein said 2,2-ethyl-butyl-1,3-propanediol is present in said toner in an amount of from about 0.48 to about 0.5 mole percent.

16. A toner in accordance with claim 1, wherein the resin has the structure

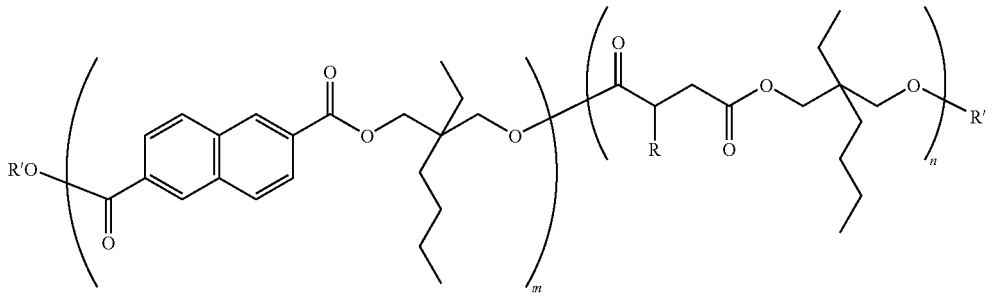

wherein R is a hydrocarbon of from about 2 to about 21 carbon atoms, m may be from about 1 to about 10, n may be from about 90 to about 99, provided that the sum of m and n is 100, and R' may be an acidic moiety represented as

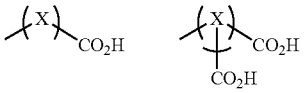

wherein X is an aryl or aliphatic moiety having from about 2 to about 18 carbon atoms.

17. A toner comprising:

a polyester resin derived from a naphthalenic material in an amount of from about 0.3 to about 0.52 mole percent, a 2-alkyl succinic material present in an amount of from about 0 to about 0.2 mole percent, and 2,2-ethyl-butyl-1,3-propanediol in an amount of from about 0.48 to about 0.50 mole percent;

a wax; and a colorant.

18. A toner in accordance with claim 17, wherein said napthalenic material is selected from the group consisting of 2,6 napthalene dicarboxylic acid, dimethyl 2,6-napthalene dicarboxylate, diethyl 2,6-napthalene dicarboxylate, dipropyl 2,6-napthalene dicarboxylate, di-isopropyl 2,6-napthalene dicarboxylate, dibutyl 2,6-napthalene dicarboxylate, and combinations thereof.

19. A toner in accordance with claim 17, wherein said 2-alkyl succinic material is selected from the group consisting of 2-ethyl succinic acid, 2-propyl succinic acid, 2-butyl succinic acid, 2-pentyl succinic acid, 2-hexyl succinic acid, 2-heptyl succinic acid, 2-octyl succinic acid, 2-dodecylsuccinic acid, 2-octadecyl succinic acid, as well as diesters and anhydrides thereof.

20. A toner comprising:

a polyester resin derived from 2,6 napthalene dicarboxylic acid, 2,2-ethyl-butyl-1,3-propanediol, and 2-dodecyl-succinic acid;

a wax; and a colorant, wherein said carbon/oxygen ratio of said polyester resin is from about 4 to about 9.

* * * * *